US006505565B1

(12) United States Patent
Byung et al.

(10) Patent No.: US 6,505,565 B1
(45) Date of Patent: Jan. 14, 2003

(54) COLLAPSIBLE TABLE WITH ELASTIC RETAINING ELEMENTS

(75) Inventors: Choi Sang Byung, Kyoungki-Do (KR); Byun Ho Sik, Kangbuk-Gu (KR)

(73) Assignee: NorthPole US LLC, Fremont, CA (US)

( * ) Notice: Subject to any disclaimer, the term of this patent is extended or adjusted under 35 U.S.C. 154(b) by 0 days.

(21) Appl. No.: 09/537,580

(22) Filed: Mar. 28, 2000

(51) Int. Cl.[7] ..... A47B 3/00
(52) U.S. Cl. ..... 108/115; 108/25
(58) Field of Search ..... 108/115, 25, 26, 108/35, 34; 5/110, 111; 297/16.2, 17, 19, 45, 54, 440.11, 16.1

(56) References Cited

U.S. PATENT DOCUMENTS

| | | | | | |
|---|---|---|---|---|---|
| 647,171 | A | | 4/1900 | Wiles | |
| 1,013,848 | A | * | 1/1912 | Reinert | 5/110 X |
| 1,185,568 | A | * | 5/1916 | Zeunert | 108/115 |
| 1,388,146 | A | * | 8/1921 | Scheibe | |
| 3,136,272 | A | * | 6/1964 | Sprigman | |
| 4,184,711 | A | | 1/1980 | Wakimoto | 297/16 |
| 4,547,015 | A | | 10/1985 | Wakimoto | 297/16 |
| 4,579,066 | A | * | 4/1986 | Zeigler | 108/115 X |
| 4,694,517 | A | * | 9/1987 | Lin | 5/111 X |
| 4,943,041 | A | * | 7/1990 | Romein | 5/111 X |
| 5,301,377 | A | * | 4/1994 | Kim | 5/110 |
| D411,387 | S | | 6/1999 | Zheng | D6/392 |
| 5,984,406 | A | | 11/1999 | Lee | 297/16.2 |
| 6,045,177 | A | | 4/2000 | Grace | 297/45 |
| 6,073,894 | A | * | 6/2000 | Chen | 108/115 X |
| 6,079,338 | A | * | 6/2000 | Yeh | 108/115 |
| D433,574 | S | | 11/2000 | Zheng | D6/368 |
| 6,158,361 | A | | 12/2000 | Zheng et al. | 108/118 |
| 6,234,089 | B1 | | 5/2001 | Zheng et al. | 108/115 |
| 6,247,748 | B1 | | 6/2001 | Zheng | 297/16.2 |
| 6,296,304 | B1 | | 10/2001 | Zheng | 297/45 |
| 6,302,479 | B1 | | 10/2001 | Zheng | 297/16.2 |

FOREIGN PATENT DOCUMENTS

JP 10-262738 * 10/1998

* cited by examiner

*Primary Examiner*—Jose V. Chen
(74) *Attorney, Agent, or Firm*—Larry B. Guernsey; Intellectual Property Law Offices

(57) ABSTRACT

A collapsible table (10), having a framework (12) including a number of support members (14) which are joined together by connectors (21, 26) which allow movement such that the framework (12) is moveable from a collapsed configuration (70) to an extended configuration (36). A table surface (16) is attached to the framework (12). There is also at least one elastic element (31) which serves to maintain tension in the table surface (16) so that the table surface (16) is urged to resist sagging when the framework (12) is in the extended configuration (36).

22 Claims, 4 Drawing Sheets

COLLAPSIBLE TABLE WITH ELASTIC RETAINING ELEMENTS

TECHNICAL FIELD

The present invention relates generally to equipment used in camping or recreation, and more particularly to camping furniture.

BACKGROUND ART

With the interest in camping growing every year, more and more people are taking advantage of parks and camp grounds. As always in camping situations, there is tension between the urge to "get away from it all" to "rough it", and the desire to be comfortable while doing so. The increased use of light-weight materials has made the use of camping furniture, which used to be considered a luxury, now a more common practice. Especially furniture which can be collapsed into compact form is coming to be used more and more, as it becomes more and more practical to transport these items. An item which has great utility in camping situations is a table. A table can be used to keep food items up off of the ground, and can make food preparation much easier, when the camp cook does not need to bend over cooking facilities which are on ground level. A table can also afford some isolation from ants and other crawling insects.

The use of camping tables is well known. Early tables were often made of sheet metal which folded up for transport, but which were heavy and often bulky, even when folded. Later tables often used cloth with a metal or wooden framework. These tables can typically be disassembled and collected into a compact and easily transported form. However, there has historically been a problem in making these tables sturdy enough that they can support a reasonable amount of weight, while still being light-weight enough that they are practical for campers. The top, working surface, which in such tables is usually made from a sheet of cloth, can tend to sag downward, providing an unstable surface for activities such as food preparation. In tables which may have a closed position where the framework draws towards the center as it closes, the sagging of the top surface under weight may actually threaten to collapse the entire structure.

What is desired, therefore, is a light-weight, collapsible table in which tension is applied to the top surface to prevent the working surface from sagging even when supporting reasonable amounts of weight.

DISCLOSURE OF INVENTION

Accordingly, it is an object of the present invention to provide a table which is easy to assemble and which is easily collapsible.

Another object of the invention is to provide a table which is light weight

And, another object of the invention is to provide a collapsible table which is very stable and in which the top surface is prevented from sagging.

Briefly, one preferred embodiment of the present invention is a collapsible table, having a framework including a number of support members. These support members are joined together by connectors which allow movement such that the framework is moveable from a collapsed configuration to an extended configuration. A table surface is attached to the framework so that it is substantially flat when the framework is in the extended position. There is also at least one elastic retaining element which serves to maintain tension in the table surface so that the table surface is urged to resist sagging when said framework is in the extended configuration.

An advantage of the present invention is that the connectors which join the frame members are interchangeable so that connectors can be used either as upper or lower connectors.

Another advantage of the invention is that the connectors also serve as attachment points for retainers.

And, another advantage of the invention is that the retainers preferably put tension on the framework, which then puts tension on the top surface cloth indirectly, so that fasteners from the retainers do not stress the cloth material.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
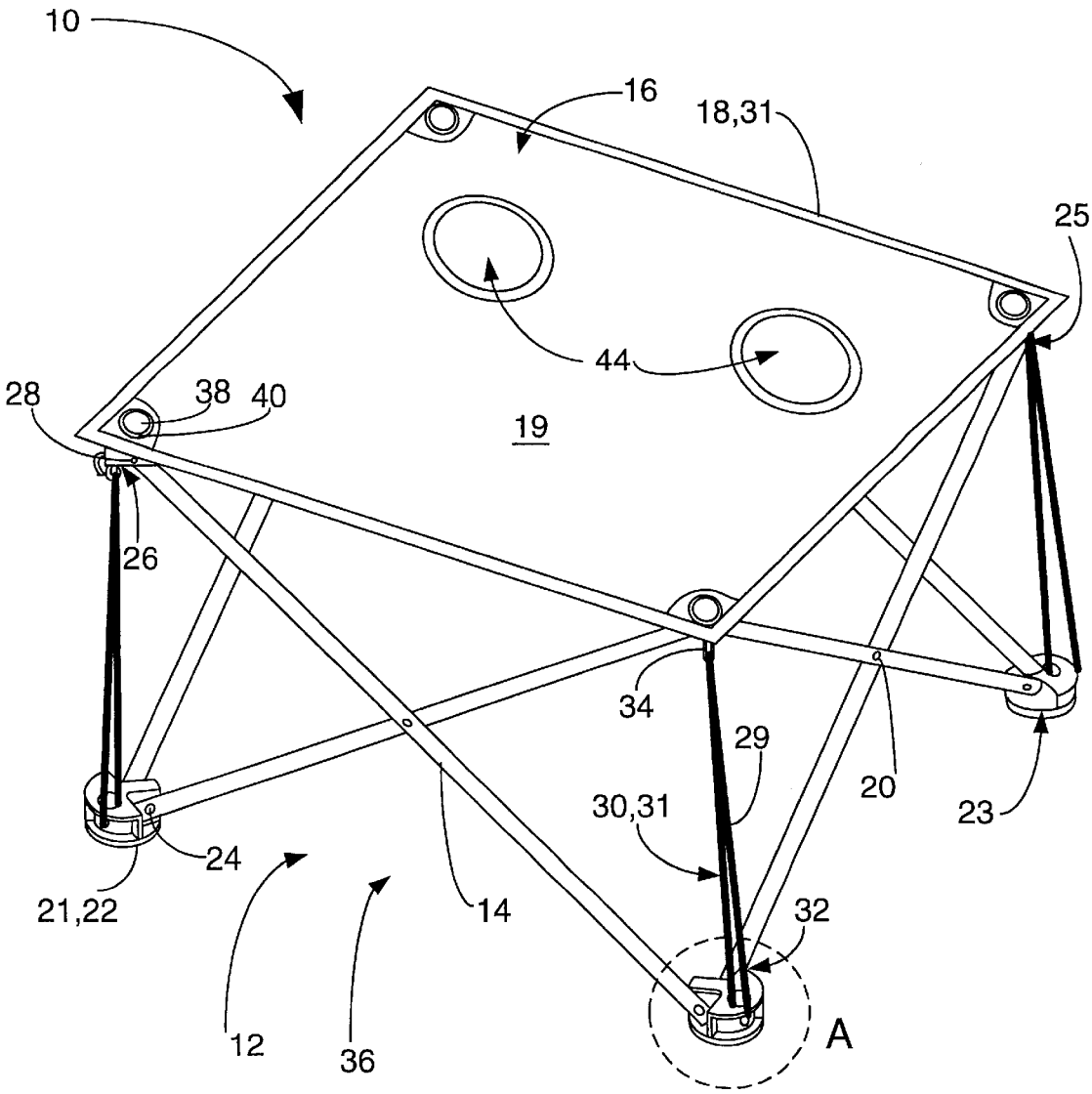
FIG. 1 illustrates a perspective view of a collapsible table in assembled configuration.

A preferred embodiment of the present invention is a collapsible table with elastic elements. As illustrated in the various drawings herein, and particularly in the view of FIG. 1, a form of this preferred embodiment of the inventive device is depicted by the general reference character 10.

FIG. 1 illustrates the basic features of the collapsible table 10, which has a framework 12 preferably made up of eight support members 14. A flexible table surface 16 is shown, which in the preferred embodiment is made of cloth such as canvas which has been reinforced with a border strip 18. The support members 14 are connected at a mid-point pivot 20, and are attached to lower connectors 21, which act as support feet 22, by lower pivots 24, and attached to upper connectors 26 by upper pivots 28. The framework 12 as a whole can then be thought of as having four lower corners 23 and four upper corners 25.

As will be discussed later, the collapsible table 10 is designed to fold up when not in use, and the table surface 16 will tend to sag under weight unless a counter force is imposed to keep the table surface 16 taut. To this end, retainers 30, preferably cords 29, of which some portion is elastic, are provided. Each retainer 30 preferably has a loop 32 and a hook 34, and attaches to the lower connectors 21 and upper connectors 26. The retainers 30 are one kind of elastic element 31, which are designed to supply constant outward tension which keeps the framework 12 in an extended configuration 36, in which the support members 14 are spread apart and the table surface 16 is kept from sagging. It is possible that the retainers 30 are only partially elastic, such as rope or chain which has elastic portions, or a spring included. It is also possible that the retainers be completely non-elastic, but there is difficulty in maintaining proper tension in the table surface as material ages and stretches, and tends to sag. However, it is also possible that the material of the table surface 16 itself could be elastic, in all or part. For example, the border strip 18 could be another kind of elastic element 19, while the central table surface 19 could be of non-elastic cloth. This would allow proper tension to be maintained while using retainers 30, which are non-elastic. It is also possible for retainers 30 to be included on less than all comers of the table 10. They could be included, for example on only two diagonal comers, although overall stability may be less than when retainers on all four comers are used.

The table surface 16 preferably has retaining nuts 38 inserted through comer grommets 40. The retaining nuts 38 are engaged by retaining screws 42 (see FIG. 3). The table surface also optionally includes storage wells 44, which may have pockets of mesh materials for holding beverage containers or canned goods.

Figure 2:
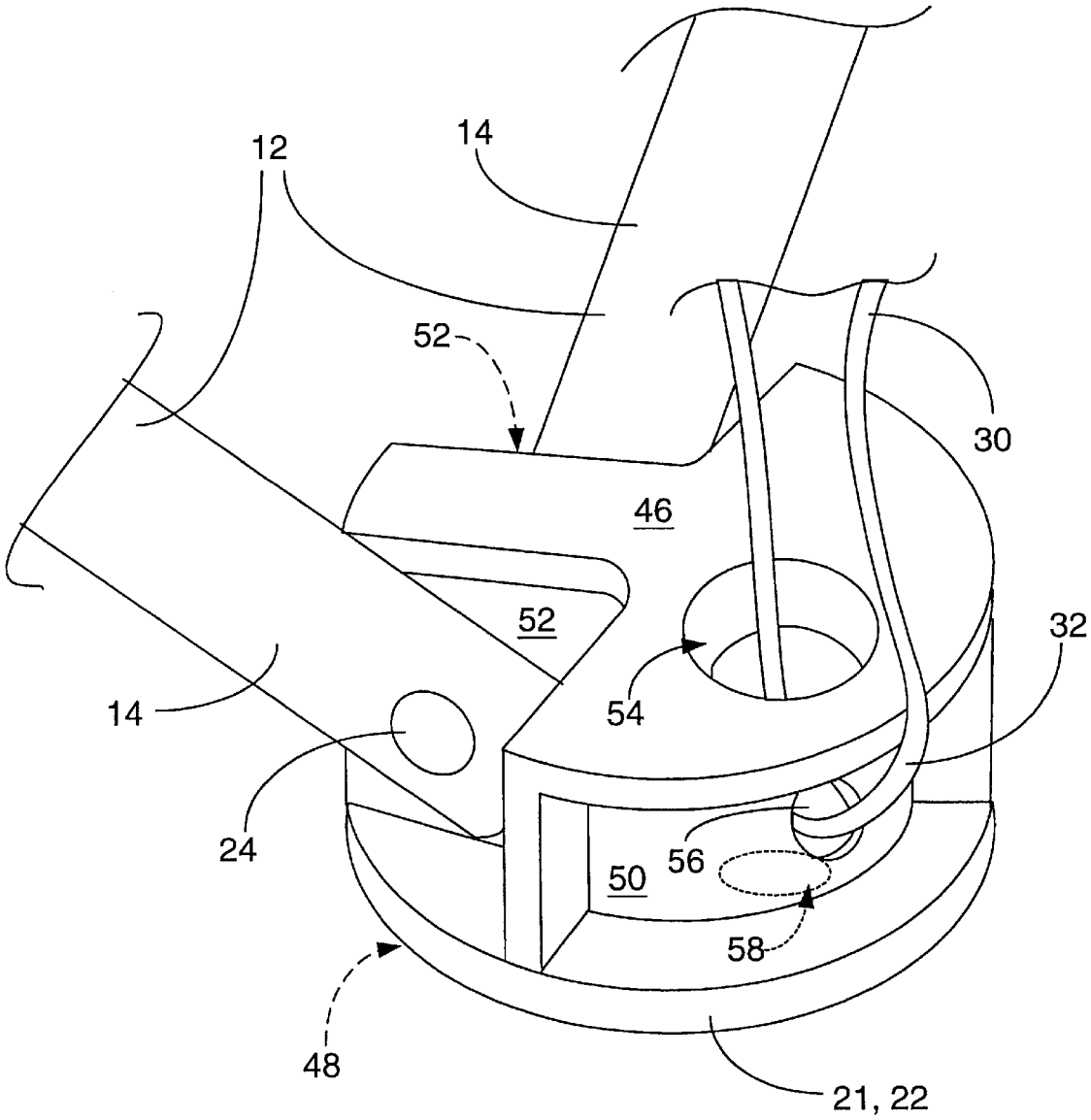
FIG. 2 shows a detail view of the portion of FIG. 1 within detail circle A.

FIG. 2 is a detail view of the area enclosed in circle "A" in FIG. 1. Two support members 14 which make up the framework 12 are shown, which are attached to lower connector 21 at lower pivots 24 (only one is visible). The lower connector 21, (also support foot 22) can be considered to have an first surface 46 and second surface 48 upon which it rests, as well as a curved side wall 50 and cutaway walls 52 (again, only one is visible). The lower pivot 24 fastens the support member 14 to a cutaway wall 52, which allows pivoting movement of the support member 14 in a vertical plane parallel to that of the cutaway wall portion 52.

A first surface hole 54 is shown in the first surface 46, and a side-wall hole 56 is shown in the side wall 50. An additional, second surface hole 58, not directly visible here and thus shown in dashed outline, is optionally included on the second surface 48, and will be discussed later in regard to FIG. 3. Retainer 30 is also shown with a loop 32 fashioned by passing the retainer 30 through first surface hole 54 and out through side-wall hole 56. It is also possible that it could alternatively pass through second surface hole 58, or that a hooks could be provided at both ends of the retainer 30 so that a lower hook could be engaged in a side wall hole 56 or first surface hole 54, or alternately, a ring (not shown) attached to the connector 21. The retainer 30 could in fact have no hooks at all, if a hook or other connection site were provided on the lower connectors 21 and upper connectors 26 (see FIGS. 1 and 3). Another variation allows a loop to be drawn in the upper connector 26, while a hook engages the lower connector 21. The retainer 30 shown is not under tension for ease of viewing, but it is assumed that in use, the retainer 30 will be pulled tight.

Figure 3:
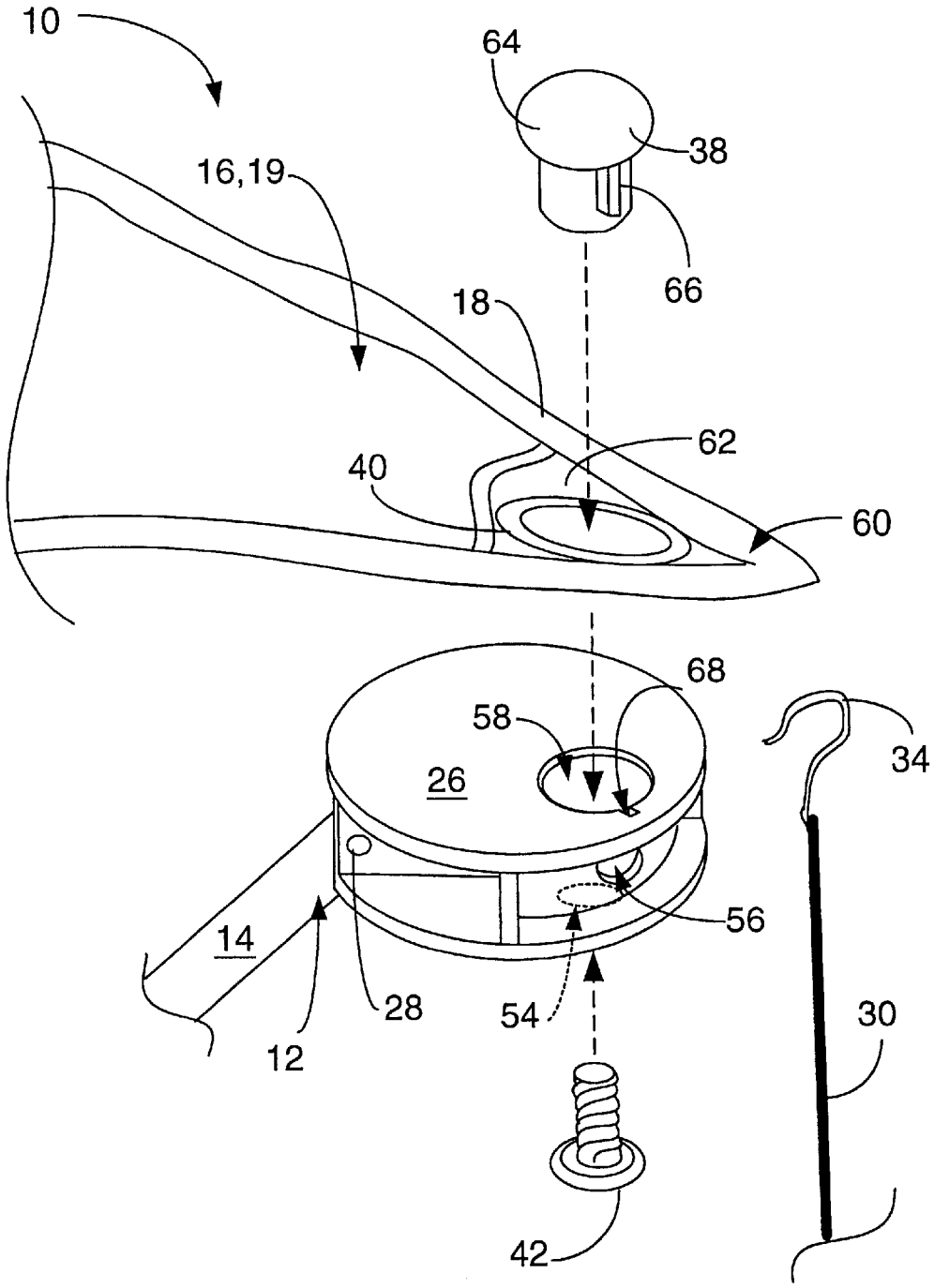
FIG. 3 illustrates an exploded view of an upper corner of the collapsible table.

FIG. 3 illustrates a corner of the collapsible table 10 in exploded view showing the upper connector 26 and its attachments. A corner 60 of the table surface 16 is shown preferably having a corner reinforcement 62 into which a grommet 40 has been inserted to further protect the table surface material from tearing. The upper connector 26, for ease of manufacture, is preferably identical to the connector 21 used in the lower portion as a support foot 22, only it is now turned upside-down. The features will be referred to by the same names and element numbers where possible, so that the second surface hole 58 is shown here actually on the top, and first surface hole 54 is shown in dashed lines on the bottom of the connector 26. Also shown are side-wall hole 56, and upper pivot 28, by which the connector 26 is attached to support member 14. Retaining nut 38 preferably is internally threaded, and includes a top button 64 of sufficient diameter that it engages grommet 40 as the lower portion passes through the grommet 40 and second surface hole 58. The retaining nut 38 includes a location flange 66 which engages the location notch 68, and prevents the retaining nut 38 from turning. Once it is seated, the retaining screw 42 engages the internal threads of the retaining nut 38. The hook 34 of the retainer 30 can then be inserted either into the side-wall hole 56 to emerge from the top surface hole 54, or into the top surface hole 54 to emerge from the side-wall hole 56. The retainer 30, assumed to be elastic, thus maintains a downwards force on the upper connectors 26, and the attached support members 14, thus urging the framework 12 to stay in the extended configuration. This also tensions the material of the table surface 16, keeping it flat and preventing sagging.

Figure 4:
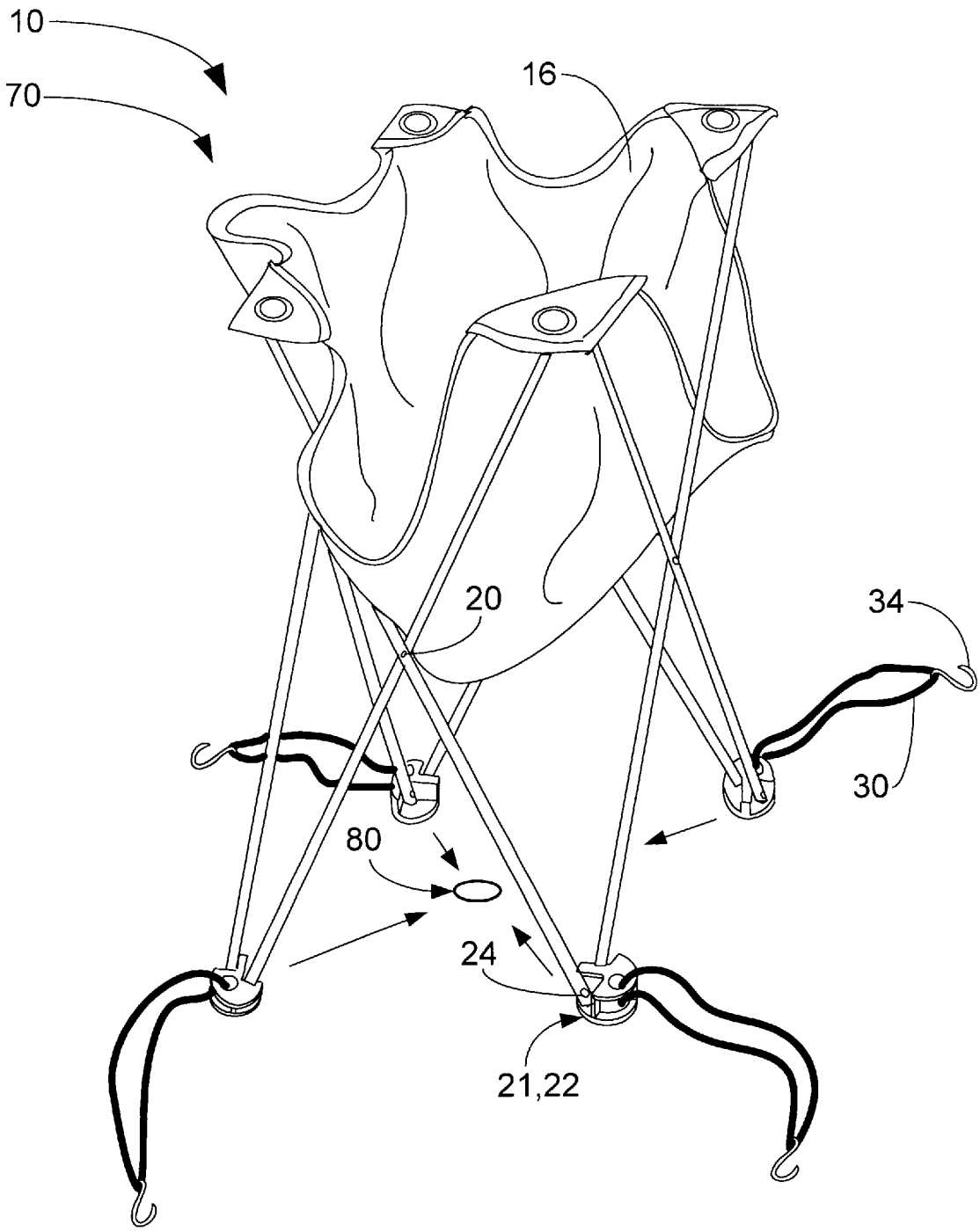
FIG. 4 shows a perspective view of a collapsible table which has been collapsed.

FIG. 4 shows the table 10 in collapsed configuration 70. The hooks 34 of the retainers 30 have been disengaged from the upper connectors 26 (not visible in this view). With the tension released, the support members 14 have been allowed to pivot at their mid-point pivots 20, and at their lower pivots 24 and upper pivots 28 (also not visible in this view). The support feet 22 are thus drawn together, as are the upper connectors 26, and the framework 12 as a whole. The table surface 16 thus collapses inward, the support feet 22 moving generally toward a central area 80, as indicated by the direction arrows, and the whole collapsible table 10 folds to a compact collapsed configuration 70. The figure thus depicts an extreme condition which could result if the retainers 30 were not included and a heavy weight were to be placed in the center of the table surface 16.

It should also be understood that all the lines of direction of the movement of the feet are not expected to intersect at a precise point. The central area 80 is thus a relatively small region toward which the feet 22 move inwardly, but there should be no inference that all feet must move in a specific lines, such as radially from a single specific center point. Thus, the expansion is considered to move inwardly toward a central area or region, and should not be construed to imply any particular lines of direction, other than generally inward toward this central area. The direction arrows and central area 80 shown in FIG. 4, are therefore not provided to show specific lines of movement which must be followed, but merely a general direction of movement towards, or away from, a general central area 80. surface 16 may also be made of many different materials such as fabric, plastic, chain mesh, woven ropes or even linked plates, perhaps of metal, as long as the table surface 16 can be folded, unlinked, or otherwise collapsed to a portable configuration. The top surface 16 may be removable, as shown, or may be integrally attached to the framework 12.

Likewise, the support members 14 which are shown as preferably round and tubular, can also be square or rectangular in cross-section, and are preferably hollow for weight considerations, but could be also be solid members of lightweight material such as aluminum, etc.

In addition to the above mentioned examples, various other modifications and alterations of the collapsible table with retainers 10 may be made without departing from the invention. Accordingly, the above disclosure is not to be considered as limiting and the appended claims are to be interpreted as encompassing the true spirit and the entire scope of the invention.

Iindustrial Applicability

The present collapsible table 10 is well suited for application in camping and picnicking, as well as for casual use in backyards and garages, patios, and porches. One of the main advantages of the present invention is its portability, as it is capable of being collapsed to a compact size, and is very light weight, while still being sturdy enough to withstand considerable weight. When collapsed, the table will easily fit inside a standard camping backpack, and can even be carried in some of the larger day-packs.

When it is to be assembled, the user can push the top connectors 26 away from each other, which spreads the table surface 16, and causes the support members 14 to scissor by pivoting at the mid-point pivots 20, so that the lower connectors 21 also spread apart from each other. When the framework 12 has been moved into extended configuration, the retainers 30 are attached to the connectors 21, 26 by hooks 34 which engage holes 54, 56, 58 or rings in the connectors 21, 26, or by loops in the retainers 30. Elastic elements 31 in either the retainer 30 or the table surface 16 are stretched when the retainers 30 have been engaged, so that the table surface 16 is taut, and flat, even when moderate weight is placed on the table surface 16.

For the above, and other, reasons, it is expected that the collapsible table 10 of the present invention will have widespread industrial applicability. Therefore, it is expected that the commercial utility of the present invention will be extensive and long lasting.

What is claimed is:

1. A collapsible table, comprising:

a framework including a plurality of support members, said support members being joined together by connectors, said connectors including upper and lower connectors to which said support members are pivotally attached, which allow movement such that said framework is moveable from a collapsed configuration to an extended configuration;

said lower connectors act as support feet, said support feet moving generally towards a central area as said framework moves from said extended configuration towards said collapsed configuration;

a table surface attached to said framework; and at least one elastic retaining element which serves to maintain tension in said table surface so that said table surface is urged to resist sagging when said framework is in said extended configuration, said upper and lower connectors including attachments sites for attaching said at least one said elastic retaining element.

2. A collapsible table as in claim 1, wherein:

said at least one elastic retaining element attaches to said framework to maintain it in said extended configuration, and thereby maintains tension in said table surface.

3. A collapsible table as in claim 1, wherein:

said at least one elastic retaining element attaches to said table surface to maintain tension in said table surface, and thereby urges said framework to remain in said extended configuration.

4. A collapsible table, comprising:

a framework including a plurality of support members, said support members being joined together by connectors, said connectors including upper and lower connectors to which said support members are pivotally attached, which allow movement such that said framework is moveable from a collapsed configuration to an extended configuration;

said lower connectors act as support feet, said support feet moving generally towards a central area as said framework moves from said extended configuration towards said collapsed configuration;

a table surface attached to said framework; and at least one elastic retaining element which serves to maintain tension in said table surface so that said table surface is urged to resist sagging when said framework is in said extended configuration, where said upper and lower connectors are interchangeable.

5. A collapsible table as in claim 1, wherein:

said at least one elastic retaining element attaches between one of said upper connectors and one of said lower connectors.

6. A collapsible table as in claim 5, wherein:

said at least one elastic retaining element includes at least one hook by which said elastic retaining element attaches to an attachment site of one of said upper connectors.

7. A collapsible table as in claim 5, wherein:

said at least one elastic retaining element includes at least one hook by which said elastic retaining element attaches to an attachment site of one of said lower connectors.

8. A collapsible table as in claim 5, wherein:

said at least one elastic retaining element includes two hooks by which said elastic retaining element attaches to an attachment site of one of said upper connectors and an attachment site of one of said lower connectors.

9. A collapsible table as in claim 5, wherein:

said framework includes four upper corners, each of which includes an upper connector; and said at least one elastic retaining element includes four elastic retaining elements, one of which is attached to each of said upper connectors.

10. A collapsible table as in claim 9, wherein:

said framework further includes four lower corners, each of which includes a lower connector; and said four elastic retaining elements, each being attached between one of said upper connectors and one of said lower connectors.

11. A collapsible table as in claim 1, wherein:

said table surface is configured in a shape chosen from the group consisting of square, rectangular, hexagonal, octagonal, and round.

12. A collapsible table as in claim 1, wherein:

said support members are configured to have a cross-sectional shape chosen from the group consisting of square tubular, rectangular tubular, round tubular, square solid, rectangular solid and round solid.

13. A collapsible table as in claim 1, wherein:

said table surface is detachable from said framework.

14. A collapsible table as in claim 1, wherein:

said table surface is composed of material selected from the group comprising fabric, flexible plastic, chain mesh, woven material, and linked plates.

15. A collapsible table as in claim 1, wherein:

said at least one elastic retaining element is part of the table surface.

16. A collapsible table, comprising:

a framework including a plurality of support members, said support members being joined together by connectors, said connectors including upper and lower connectors to which said support members are pivotally attached, which allow movement such that said framework is moveable from a collapsed configuration to an extended configuration;

said lower connectors act as support feet, said support feet moving generally towards a central area as said framework moves from said extended configuration towards said collapsed configuration;

a table surface attached to said framework; and at least one elastic retaining element which serves to maintain tension in said table surface so that said table surface is urged to resist sagging when said framework is in said extended configuration, where said at least one elastic retaining element is part of a border strip surrounding a central portion of said table surface.

17. A collapsible table as in claim 1, wherein:

said tension in said elastic retaining elements opposes the movement of said support feet toward said central area, thus serving to maintain said table in said extended position, and maintaining tension in said table surface.

18. A collapsible table as in claim 1, wherein:

said support feet move in a generally radial direction from said central area, when said framework moves from a collapsed configuration towards an extended configuration.

19. A collapsible table as in claim 1, wherein:

said support members are pivotally connected by midpoint pivots, as well as being pivotally connected at upper and lower connectors, so that said framework expands or contracts as a whole; and said at least one elastic retaining element is a single retaining element.

20. A collapsible table as in claim 1, wherein:

said support members are pivotally connected by midpoint pivots, as well as being pivotally connected at upper and lower connectors, so that said framework expands or contracts as a whole; and said at least one elastic retaining element is a pair of retaining elements.

21. A collapsible table as in claim 1, wherein:

said upper and lower connectors are interchangeable.

22. A collapsible table as in claim 1, wherein:

said at least one elastic retaining element is part of a border strip surrounding a central portion of said table surface.

* * * * *